US006758221B1

(12) United States Patent
Stachowski

(10) Patent No.: US 6,758,221 B1
(45) Date of Patent: Jul. 6, 2004

(54) SPIRAL HAIR PINS

(76) Inventor: Barbara Stachowski, 11 El Gavilan, Orinda, CA (US) 94563

( * ) Notice: Subject to any disclaimer, the term of this patent is extended or adjusted under 35 U.S.C. 154(b) by 0 days.

(21) Appl. No.: 09/835,011

(22) Filed: Apr. 13, 2001

Related U.S. Application Data

(60) Provisional application No. 60/237,952, filed on Oct. 3, 2000.

(51) Int. Cl.[7] ..... A45D 8/04; A45D 8/12

(52) U.S. Cl. ..... 132/273; 132/275

(58) Field of Search ..... 132/273, 275, 132/280, 276; 276/166, 286; D28/39, 40; D11/20

(56) References Cited

U.S. PATENT DOCUMENTS

| | | | | | |
|---|---|---|---|---|---|
| 482,257 | A | | 9/1892 | Larkin | |
| 674,303 | A | * | 5/1901 | Morgan | D28/39 |
| D44,635 | S | * | 9/1913 | Fleischmann | 132/273 |
| 1,862,992 | A | * | 6/1932 | Vargha | 29/160.6 |
| 2,455,715 | A | | 12/1948 | Webster | 132/46 |
| 2,924,228 | A | | 2/1960 | McGee | 132/46 |
| 3,247,856 | A | * | 4/1966 | Weeks | 132/273 |
| D302,252 | S | * | 7/1989 | Sykes | D11/40 |
| 4,979,276 | A | * | 12/1990 | Chimento | 29/160.6 |
| D317,663 | S | * | 6/1991 | Calderon | D28/39 |
| 5,271,421 | A | | 12/1993 | Videtzky | 132/200 |
| 5,318,054 | A | | 6/1994 | Neilson et al. | 132/273 |
| 5,495,861 | A | | 3/1996 | Liberman | 132/273 |
| D372,338 | S | * | 7/1996 | Engel et al. | D28/39 |
| 5,530,970 | A | * | 7/1996 | Knutson | 2/209.13 |
| 6,164,292 | A | | 12/2000 | Di Maria Poole et al. | 132/275 |
| 6,192,893 | B1 | * | 2/2001 | Katsumata | 132/273 |

FOREIGN PATENT DOCUMENTS

| | | | |
|---|---|---|---|
| FR | 501311 | 10/1921 | |
| FR | 2490939 | 4/1982 | A45D/8/34 |
| FR | 2631527 | 11/1989 | A44B/21/00 |
| GB | 21486 | of 1911 | |

* cited by examiner

*Primary Examiner*—John J. Wilson
*Assistant Examiner*—Robyn Kieu Doan
(74) *Attorney, Agent, or Firm*—Haverstock & Owens LLP

(57) ABSTRACT

The current invention is for a device, a method and a system for styling hair. The preferred device of the instant invention is a hair pin that spirals with two or more rotations from a larger bottom section with a pointed end to a smaller top section with a blunted or enlarged end. The hair pin is preferably elongated and forms a substantially uniform cone shape with an inner spiral region. In the preferred method of the invention, a portion of hair is secured within the inner spiral region of the hair pin by placing the tapered or pointed end of the spiral hair pin into a section of hair and twisting the hair pin in a direction opposite to the spiraling direction of the hair pin, such that the hair pin passes through the hair at least twice and captures or gathers the portion hair within the inner spiral region. In the system of the invention, a first spiral hair pin is used in conjunction one more additional hair pins, whereby the one or more additional hair pins are threaded through hair and between one or more spirals of the first hair pin.

25 Claims, 7 Drawing Sheets

SPIRAL HAIR PINS

RELATED APPLICATION(S)

This Patent Application claims priority under 35 U.S.C. 119 (e) of the now abandoned U.S. Provisional Patent Application, Serial No. 60/237,952, filed Oct. 3, 2000, and entitled "HAIR STYLING SYSTEM, DEVICE AND SYSTEM". The Provisional Patent Application, Serial No. 60/237,952, filed Oct. 3, 2000, and entitled "HAIR STYLING SYSTEM, DEVICE AND SYSTEM" is also hereby incorporated by reference.

FIELD OF THE INVENTION

The invention relates to hair styling devices, methods and systems. More specifically, this invention relates to a hair styling devices, methods and systems for securing and retaining a portion of hair.

BACKGROUND OF THE INVENTION

Hair styling often involves manipulating hair into a preferred orientation or style and securing the hair in that preferred orientation or style. Typical devices include barrett devices and loop securing devices. All of these types of device secure sections of hair by wrapping around a selected tuft or strand of hair.

Videtzky in U.S. Pat. No. 5,271,421 describes a device with two co-acting circular helical coils with a pocket between the two co-acting coils. The device is screwed into the user's hair and strands of the hair are held between pockets formed by the coils and pass through the pockets. Webster in U.S. Pat. No. 2,455,715 describes a spiral shaped hair support and retaining device that is place over the users hair and encircles an entire coiffure of hair. The device is held in position through tension applied to the users head through the device. Larken in U.S. Pat. No. 482,257 describes a spiral hair pin that is used to hold a piece of jewelry or other ornament in the user's hair. The spiral design affords the pin greater holding power when inserted into the user's hair. In the U.S. Pat. No. 2,924,228, issued to McGee, and U.S. Pat. No. 5,878,755, issued to Crabtree et al., spiral hair clasps that are configured to fit around a strand of hair are described.

Other patents describe spiral hair styling devices that are configured to accept hair into the channel of spiral and securing the hair therein. Examples include, U.S. Pat. No. 3,247,856, issued to Weeks, U.S. Pat. No. 5,495,054, issued to Liberman, U.S. Pat. No. 5,318,504, issued to Neilson et al, French publication No. 2,631,527 and French publication No. 2,490,939. These and other hair styling devices are attached around a strand of to hold the strand of hair or to decorate the strand of hair. What is need is a hair styling device that is configured to secure and retain a section or bundle of hair in a preferred position on the user's head.

SUMMARY OF THE INVENTION

The current invention is directed to a device, system and method for styling hair. The device of the invention is a hair pin with a spiral body section. Preferably, at least one end of the body section is tapered or pointed for assisting in the threading of the hair pin through the hair. Preferably, the other opposite end of the spiral body section is configured to catch hair or to resist threading through the hair. The cross-section of the spiral body can have any number of shapes. The body section cross-section is constant or varied. Preferably, the spiral body section has a circular and substantially constant cross-section with a diameter in the range of 0.25 and 1.5 cm.

The device is formed from any material, but is preferably resilient such that the body section is capable of being reversibly deformed, compress and or expanded. The device is preferably formed as a single molded piece from a resilient material such as plastic, rubber, polyurethane or other suitable resilient material.

In accordance, with the preferred embodiment of the invention, the hair pin spirals from a bottom spiral section having larger radii of rotation to a top spiral section having smaller radii of rotation and with the tapered or pointed end correspond to the bottom spiral section. The spiral body section comprises two or more revolution in the spiraling direction and spirals clockwise or counter clockwise from the tapered or pointed bottom end.

The spiral body section is elongated and forms a substantially uniform cone shape with an inner spiral region. The cone angle of the substantially uniform cone shape is in the range of 120 and 10 degrees. The elongated spiral body section preferably has a rotational gradient in the range of 0.25 to 1 rotations/cm in the elongated direction. Preferably, the bottom spiral section has a diameter in the range of 8 and 24 cm, the top spiral section has a diameter in the range of 4.0 and 14 cm and a length in the elongated spiraling direction in the range of 6.0 and 32 cm.

In use, hair is gathered using hands or a suitable styling device to gather hair, such as a comb or a brush. Once hair is gathered, a portion of hair is secured with the spiral hair pin. The portion of hair is secured by placing the tapered or pointed end of the spiral hair pin into the hair and twisting the hair pin in a direction opposite to the spiraling direction substantially of the hair pin, such that the hair pin passes through the hair at least twice and captures the portion hair within the inner spiral region.

In an embodiment of the method, the hair pin is held with the bottom spiral section substantially parallel to the user's scalp and over a portion hair. Twisting the hair pin in a direction opposite to the spiraling direction of the hair pin causes the hair pin passes through the section of hair and capture the portion of hair within the inner spiral region of the hair pin.

In yet another embodiment of the method, the hair pin is held with the elongated spiraling direction substantially parallel to the user's scalp. Twisting the hair pin in a direction substantially opposite to the spiraling direction of the hair pin causes the hair pin to pass through the hair and gather a portion of the hair within inner spiraling region of the hair pin. For the abovementioned embodiment of the method, it is preferable that hair pin spirals with four or more revolution the spiraling direction.

Once a first hair pin is secured to the hair, in accordance with the method described above, the hair pin may be garnished or decorated with any suitable attachment. Further, the spiral hair pin may be used in conjunction one more additional straight, curved or spiraling hair pins, whereby the additional hair pins are threaded through the portion of hair and between one or more rotations of the first hair pin such that the hair pins intersect.

DETAILED DESCRIPTION OF THE INVENTION

Features and combination of features of the spiral structures shown in FIGS. 1*a–d* are used, herein, to describe and explain particular properties of spiral structures. However, the features and combination of the features of the spiral structure shown in FIGS. 1*a–d* are not intended to limit the scope of the invention. Further, it is understood that the term spiral is not intended to be used in the rigorously mathematical sense, but rather intended to describe a curved structure that is curved in a rotating manner with an increasing radial distance from a real or an imaginary center point.

Figure 1A:
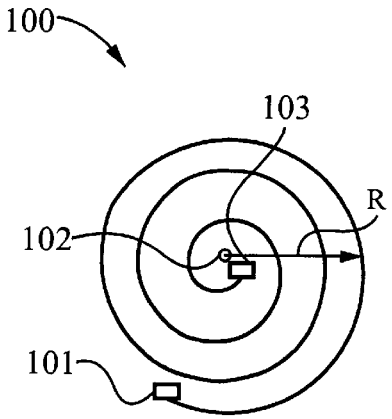
FIGS. 1*a–d* illustrate several spiral shapes and configurations.

FIG. 1*a* shows a flattened spiral 100 that spirals about a center pont 102 from a first end 101 with a larger radius of rotation to a second end 103 with a smaller radius of rotation. The spiral structure 100 spirals in a planar direction from larger radii of rotation to smaller radii of rotation through points along the spiral structure 100. A planar gradient of rotation is defined, herein, as the number of rotations per unit distance R from the center point 102.

Figure 1B:
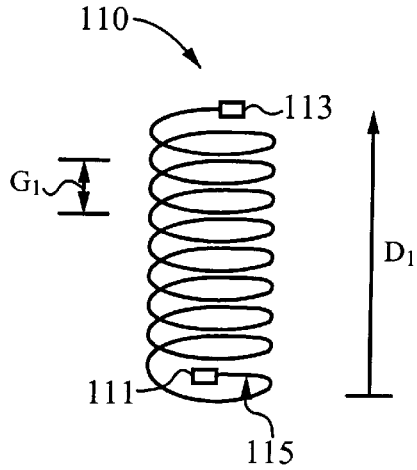

FIG. 1*b* shows spiral structure 110 that spirals in an out of plane or elongated spring direction D1 forming an inner coil region 115. The spiral structure 110, however, does not spiral in the planar direction such as the structure 100 shown in FIG. 1*a*. The gradient of rotation in the elongated direction D1 is defined, herein, as the number of rotations per unit distance G.

Figure 1C:
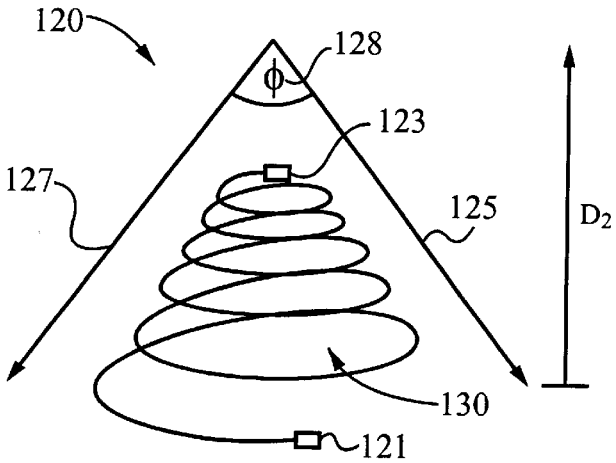

FIG. 1*c* shows a conical spiral structure 120. The conical spiral structure 120 has a first end 121 that spirals in a planar direction and in an elongated direction to the second end 123. The spiral structure has components of a planar spiral structure 100, as shown in FIG. 1*a,* and components of an elongated spiral structure 110, shown in FIG. 1*b*. The conical spiral structure spirals to form a conical inner spiral region. The shape of the conical spiral structure 120 is described, herein, in terms of the average cone angle 128 and the rational gradient. The average cone angle 128 is determined by drawing the vectors 125 and 127 along imaginary walls of the spiral structure 120, wherein the vectors 125 and 127 substantially define a plane dividing the spiral cone structure 120. The angle 128 at the intersection of the two vectors 125 and 127 is the average cone angle. The rational gradient is defined as the number of rotation per unit distance in the elongation direction D2.

Figure 1D:
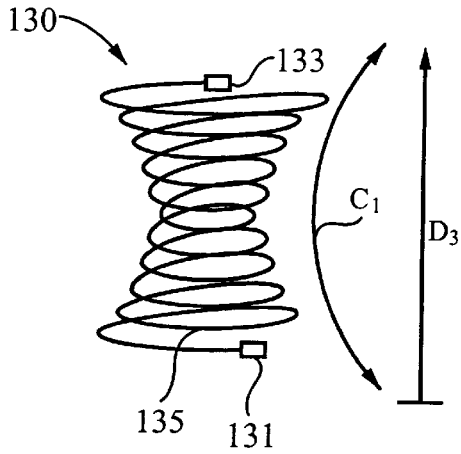

FIG. 1*d* shows a contoured spiral structure 130. The contoured spiral structure 130 has curvature $C_1$ along the imaginary walls of the spiral structure. The spiral structure 130 spirals from a first end 131 to a second end 133 in an elongated spiral direction $D_3$, and varies along in its planar rotational gradient along the elongation direction $D_3$. It will be clear to one skilled in the art, that spiral structures may be varied in a number of ways that do not negated their characterization a spiral structure. For a spiral structure maybe pseudo conical, wherein the conical shape of the structure is not symmetrical. The shapes of spiral structures may be tapered or contoured in a number of different ways and with respect to rotational gradients, may be vary in both the planar directions and elongated directions.

Figure 2A:
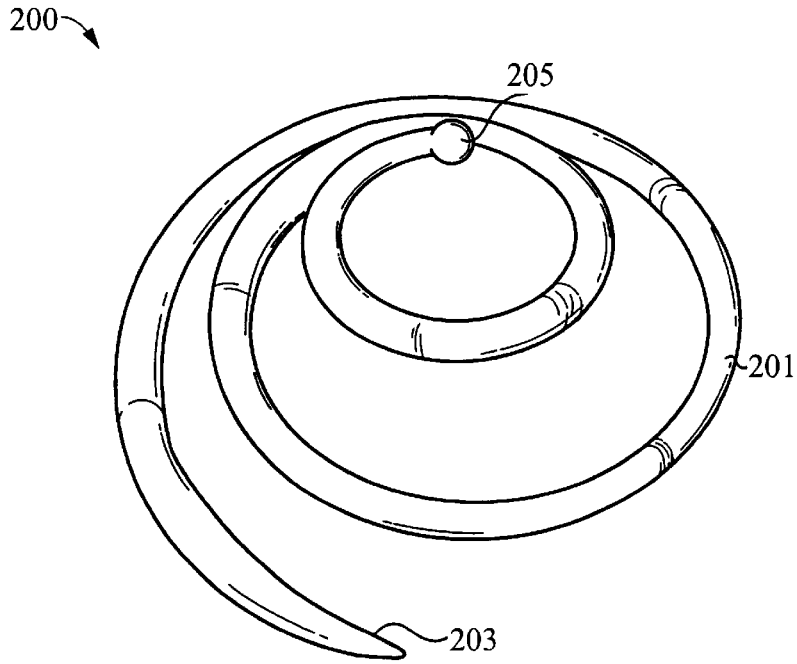
FIGS. 2*a–b* show perspective views of a spiral hair pin, in accordance with the instant invention.
Figure 2B:
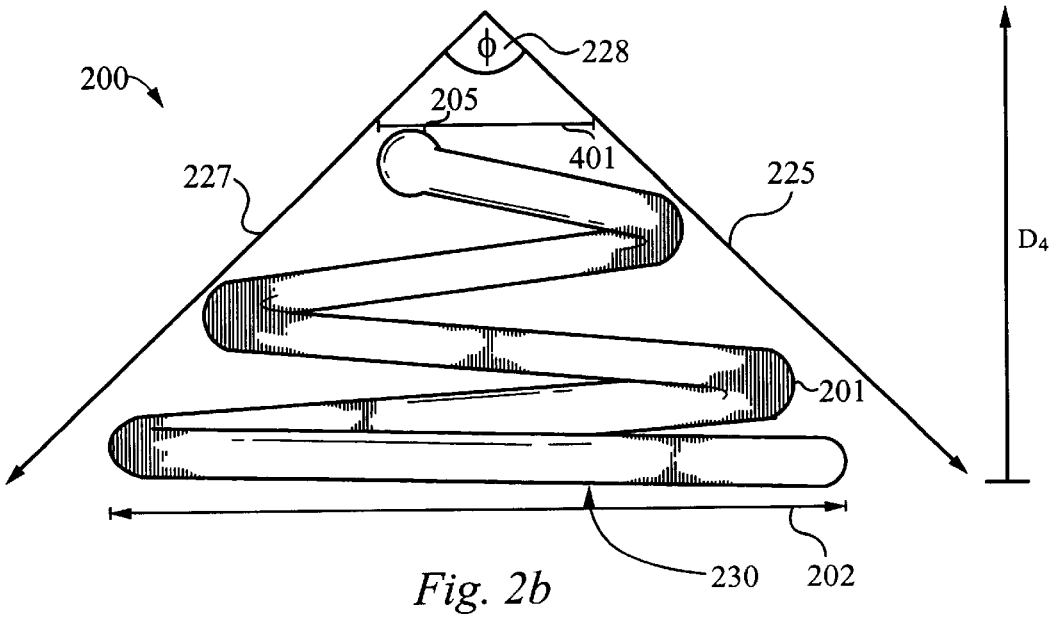

FIGS. 2*a–b* illustrate a spiral hair pin 200 in accordance with the current invention. The hair pin 200 has a body section 201 that spirals with a rotational gradient in at least one direction. The direction of the spiral is not important and the hair pin may spiral form a larger radius of rotation to a smaller radius of rotation in a clockwise or anti-clockwise direction. Preferably, the hair pin has a rotational gradient in both the planar direction $R_2$ and the elongation direction $D_4$. Further, it is preferably that the end 203 of the hair pin 200 is tapered or pointed allowing the hair pin 200 to be readily threaded through a portion of hair. The opposite end 205 of the hair pin 200 is preferably blunted, enlarged or otherwise configured to catch hair and resist threading through hair. Most preferably the pointed or tapered end 205 corresponds to the end of the hair pin 200 with the largest radius rotation.

The hair pin 200 is preferably formed as a single monolithic unit. The hair pin 200 is also preferably formed form a resilient molded material such plastic, rubbers or other suitable polymeric material such that the hair pin is capable of being reversibly deformed, compress and/or expanded. Alternatively, the hair pin 200 is made from spring metal. The hair pin 200 has any number of colors or surface designs. For example, the hair pin is opaque with surface glitter. Alternatively, the hair pin is clear with imbedded ornamental structures within the hair pin 200.

The spiral body section 201 has any number of cross-sectional shapes including triangular, square or hexagonal. Further, the body section 201 has a constant or a varied cross section. Preferably, the cross section of the body section 201 is circular and substantially constant with a diameter in the range of 0.25 and 1.5 cm.

The hair pin 200 preferably spirals to form a substantially uniform and symmetrical cone shape with an inner spiral region 230. The cone angle 228 as determined by the intersection of the vectors 227 and 225 is preferably in the range of 120 to 10 degrees with a rotational gradient in the elongation direction $D_4$ between 0.25 to 1.0 rotations/cm. The diameter 202 of the bottom spiral section is preferably in range of 8.0 to 24 cm and the diameter 204 of the top spiral section is preferably in the range of 4.0 to 14 cm. The length of the hair pin 200 in the elongated direction $D_4$ is varied depending on the intended hair style, but is preferably in the range of 6.0 to 32 cm.

Figure 3:
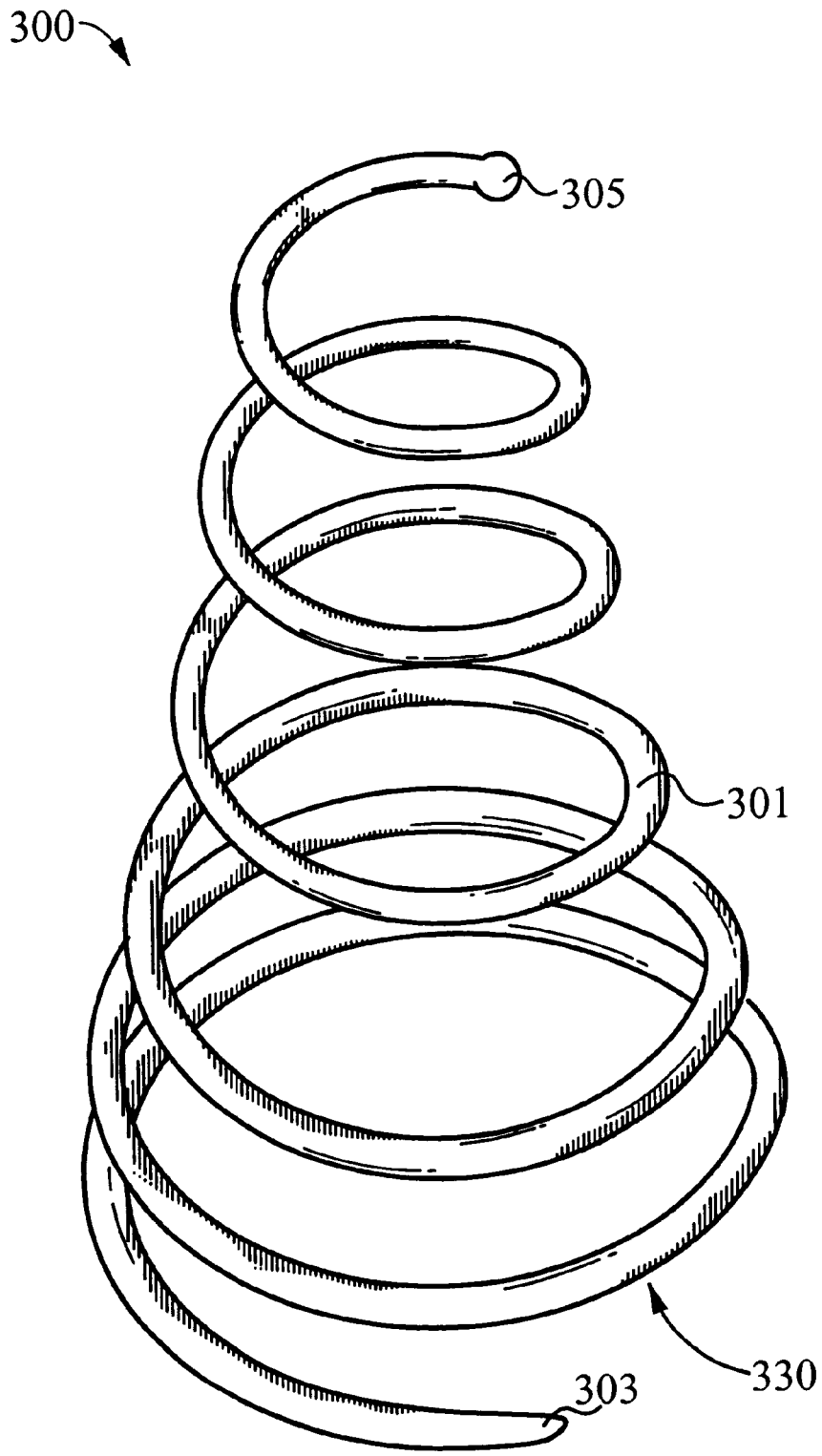
FIGS. 3*a–b* show perspective views of an elongated spiral hair in accordance with an alternative embodiment of the current invention.

FIG. 3 illustrates an alternative spiral hair pin 300 in accordance with the instant invention. Like the hair pin shown in FIGS. 2*a–b,* the hair pin 300 has a body section 301, and two ends 303 and 305. The hair pin 300 spirals from a tapered end 303 with a larger radius of rotation to the an enlarged end 305 with a smaller radius of rotation. The hair pin 300 has comparatively more rotation in the elongated spiraling direction. FIGS. 4*a–d* and FIGS. 5*a–d* will now be used to illustrates a few exemplary hair styles that utilize the spiral hair clips of the current invention.

Figure 4A:
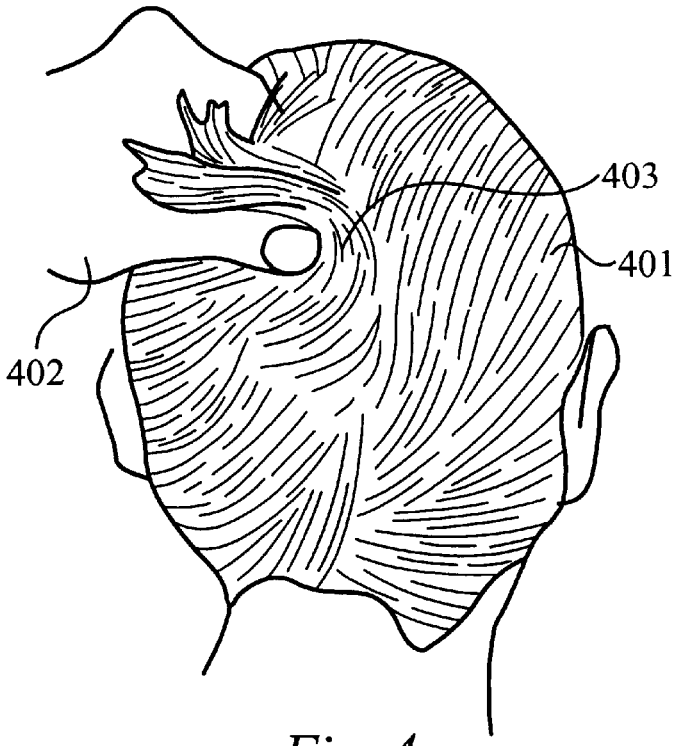
FIGS. 4*a–d* show the spiral hair pin shown in FIGS. 1*a–b* being used to secure a section of hair, in accordance with the method of the current invention.

In FIG. 4*a,* a section of hair 403 is gathered form a user's head 401 using hands 402 and 407 or any suitable styling device, such as a comb or a brush (not shown). Once the section of hair 403 is gathered, then a spiral hair pin 405 is used to secure the section of hair 403.

Figure 4B:
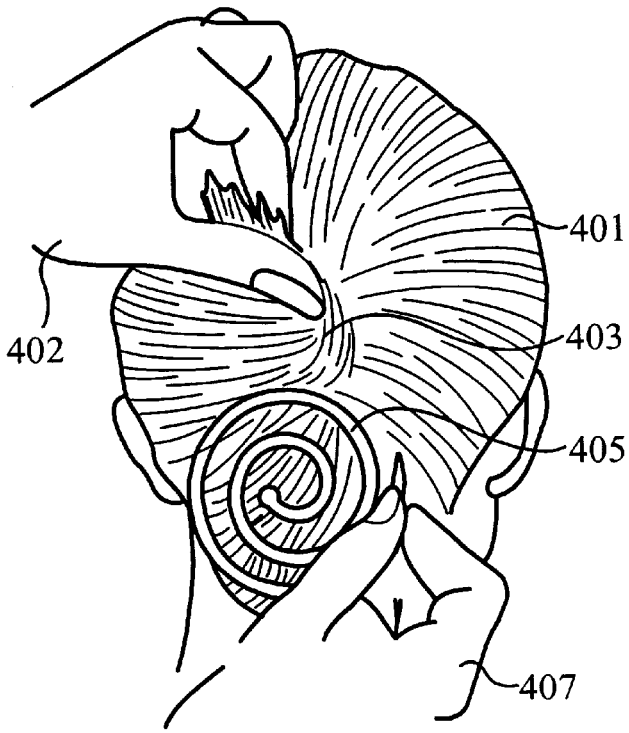

Now referring to FIG. 4*b,* in accordance with the method of the instant invention, while holding the section of hair 403 with one hand 402, the hair pin 405 is place near the section of hair 403 with the other hand 407. The bottom portion of the hair pin 405 placed substantially parallel to the user's scalp and the tapered or pointed end of the spiral hair pin 405 is placed into the hair 401. Then the hair pin 405 is twisted in a direction substantially opposite to the spiraling direction of the hair pin 405, such that the hair pin in threaded through the hair 401 and passes through the hair 401 at least twice. By twisting the hair pin 405 as described above, a portion hair 401 is captured within the inner spiral region of the hair pin 405 and secured therein.

Figure 4C:
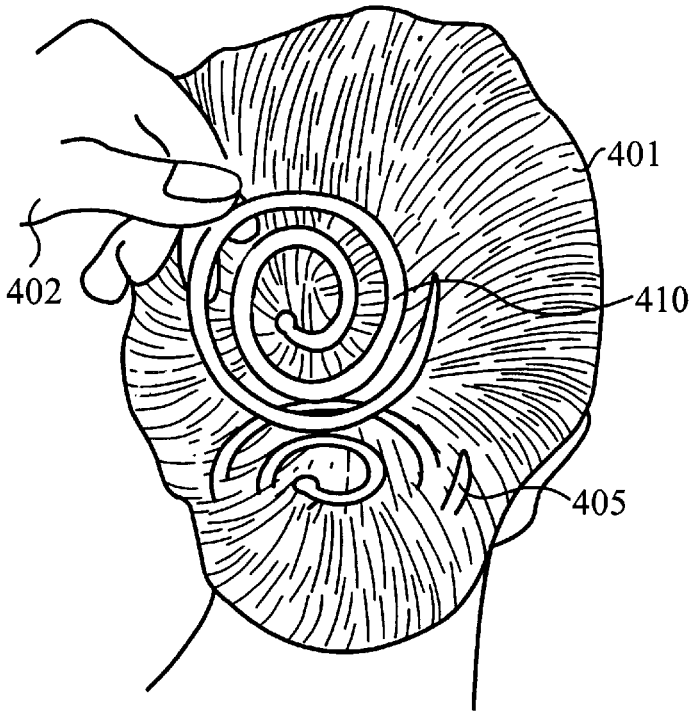
Figure 4D:
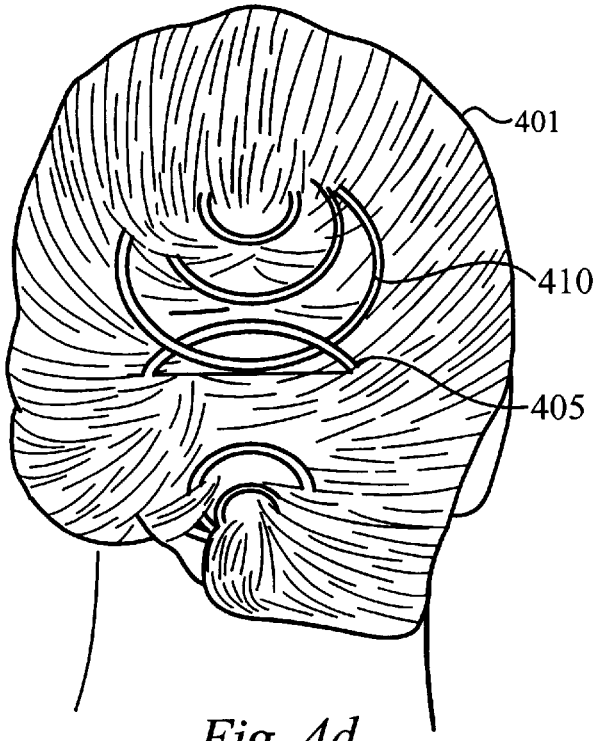

Now referring to FIG. 4*c,* in a further embodiment, a second hair pin 410 is placed. near the section of hair 403 with the bottom portion hair pin 410 placed substantially parallel to the user's scalp. Twisting the hair pin 410 in a direction substantially opposite to the spiraling direction of the hair pin 410 causes the hair pin passes through the hair 401 at least twice and captured the portion of hair within the inner spiral region of the second hair pin 410. Preferably, the hair pins 405 and 410 are threaded through the hair 401 such that the hair pins 405 and 410 intertwine and act in together to hold the section of the hair 403 with second hair pin 410 passing through a spiral of the first hair pin 405, such as shown in FIG. 4*d.*

Now referring to FIGS. 5*a–d,* in an alternative embodiment, a section or section of hair is secured in preferred orientation with an elongated hair pin 505 such as shown previously in the FIG. 3. In accordance with this embodiment, the section of hair 503 is gathered form a user's head 501 using a hand 402 of any suitable stying device. Once the section of hair 403 is gathered, then a spiral hair pin 505 is used to secure the section of hair 503.

Figure 5A:
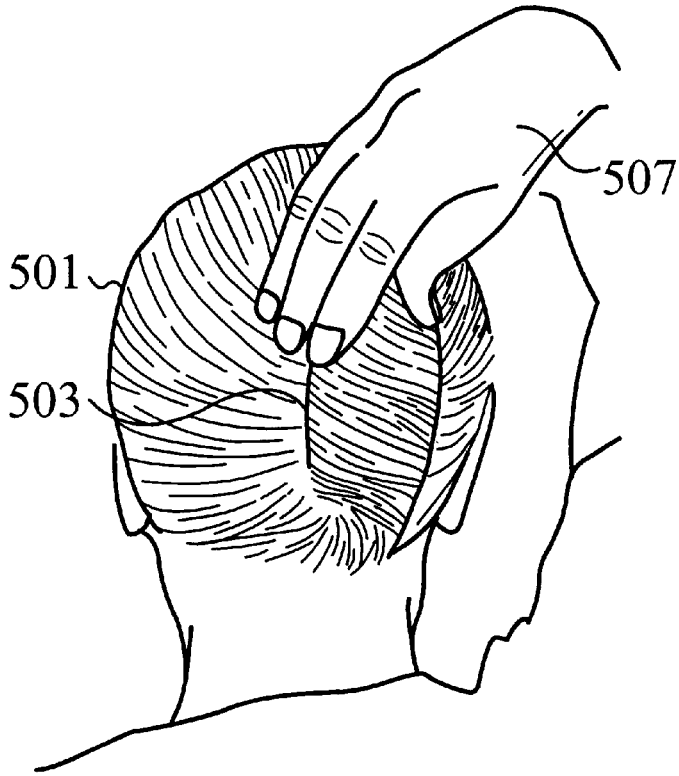
FIGS. 5*a–d* illustrate the spiral hair pin illustrated in FIGS. 2*a–b* being used to secures a section of hair, in accordance with an alternate method of the current invention.
Figure 5B:
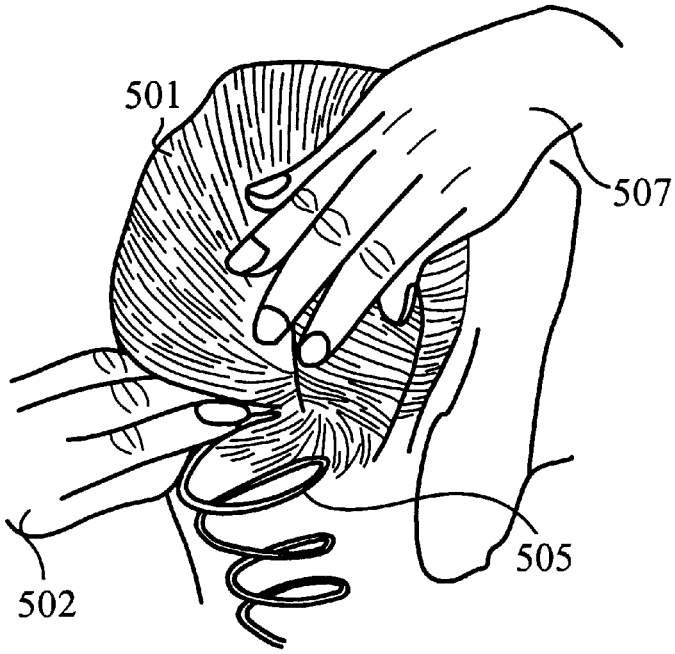
Figure 5C:
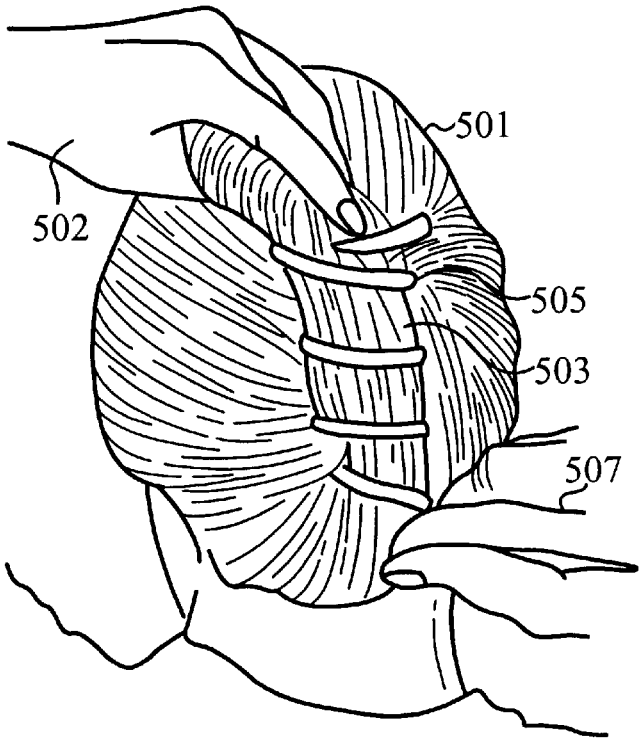
Figure 5D:
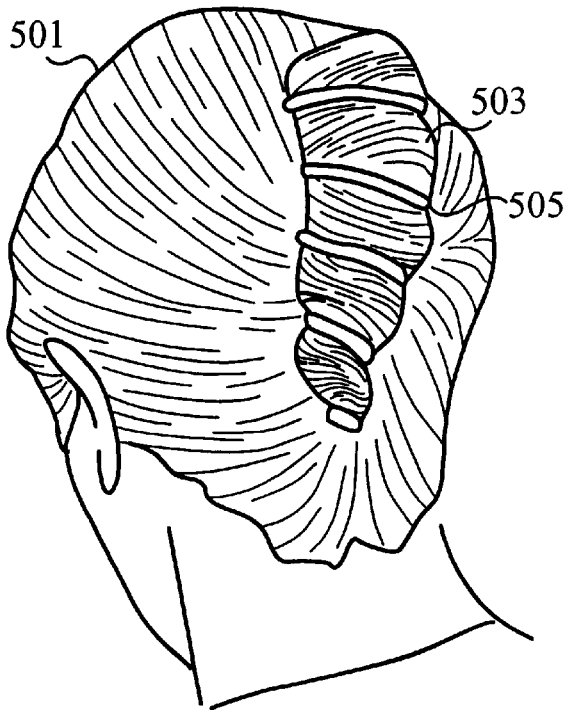

The spiral hair pin 505 is held with the elongated spiraling direction substantially parallel to the user's scalp, as shown in FIG. 5*b.* The tapered or pointed end of the spiral hair pin 505 is placed into the hair 501 and the hair pin 505 is twisted or turned in a direction substantially opposite to the spiraling direction of the hair pin 505, such that the hair pin 505 is threaded through the hair 501 and near the user's scalp. By twisting the hair pin 505, as described above, the section of hair 403 is gathered into the inner spiral region of the hair pin 505 and secured against the user's head.

In accordance with a further embodiment of the invention, once the spiral hair pins are in a secured position, the hair pins are garnished or decorated with any suitable attachment, such as a clip, a steamer, a ribbons and the like. Further, the spiral hair pins described in detail above may be used in conjunction with additional straight, curved or spiraled hair pins, whereby the one or more of the additional hair pins are threaded though spirals of other attached hair pins.

The present invention has been described in terms of specific embodiments incorporating details to facilitate the understanding of the principles of construction and operation of the invention. Such reference herein to specific embodiments and details thereof is not intended to limit the scope of the claims appended hereto. It will be apparent to those skilled in the art that modifications can be made in the embodiment chosen for illustration without departing from the spirit and scope of the invention. For example the spiral hair pin may be configured in parts with detachable ends or may be configured to couple to other hair styling devices such as clips, barretts and the like. Therefore, it is understood that the present invention could be implemented in several different ways and have several different appearances.

What is claimed is:

1. A device for styling hair, the device comprising a first spiral body section spiraling in a spiraling direction from a first end to a second end and from a larger radii of rotation to a smaller radii of rotation, wherein the first end is tapered for threading through hair and the second end is blunted to resist threading through hair, further wherein the first spiral body section attachably interwined with a second spiral body section substantially similar to the first spiral body section while the second spiral body section is threaded through the hair.

2. The device of claim 1, wherein the single member spiral body section is a conical spiral with a rotational gradient an elongated spiraling direction in the range of 0.25 to 1 rotations/cm.

3. The device of claim 2, wherein the larger radii of rotation has a diameter in the range of 8 to 24 cm and the smaller radii of rotation has a diameter in the range of 4.0 and 14 cm.

4. The device of claim 1, wherein the spiral body has a substantially constant cross-sectional geometry.

5. The device of claim 4, wherein the cross-sectional geometry is circular with a diameter in the range of 0.25 to 1.5 cm.

6. The device of claim 1, wherein the single member spiral body comprises two or more revolutions in the spiraling direction.

7. The device of claim 1, wherein the single member spiral body is formed from a resilient material.

8. The device of claim 7, wherein the resilient material is selected from the group consisting of plastic, polyurethane and rubber.

9. The device of claim 1, wherein the single member spiral body section spirals clockwise from the first end to the second end.

10. A hair pin device comprising a first hair pin with a single member body section with a substantially uniform cross-section that spirals in an elongated spiraling direction from a first pointed end to a second enlarged end of the body, wherein the body spirals with a rotational gradient from a larger rational radii beginning at the first pointed end to a smaller rotational radii at the second end of the body, wherein the first hair pin is configured to intertwine with a second hair pin while the second hair pin is threaded through hair.

11. The device of claim 10, wherein the substantially uniform cross-section is round with a cross-sectional diameter in the range of 0.25 and 1.5 cm.

12. The device of claim 10, wherein the rational gradient of the body section is in the range of 0.25 to 1.0 rotation/cm.

13. The device of claim 10, wherein the body section forms substantially uniform cone shape.

14. The device of claim 13, wherein the cone angle of the substantially uniform cone shape is in the range of 120 and 10 degrees.

15. The device of claim 10, wherein the body spirals with two or more revolutions in the elongated spiraling direction.

16. The device of claim 10, wherein the body section is monolithic and formed from a resilient material.

17. The device of claim 16, wherein the resilient material is selected from the group consisting of plastic, polyurethane and rubber.

18. A method of securing section of hair comprising the steps of:

a. gathering a section of hair;

b. threading a first hair pin spiraling from a pointed end to a blunted second end with two or more rotations in a spiraling direction through the section of hair by placing the pointed end of the hairpin into the section of hair and twisting the hair pin in a direction opposite to the spiraling direction of the hair pin, such that the hair pin passes through the section of hair at least twice; and c. threading a second hair pin into the section of hair.

19. The method of claim 18, wherein the spiraling hair pin is elongated in the spiraling direction and spirals from a bottom with a larger radii of rotation to a top with smaller radii of rotation and forming an inner spiral region.

20. The method of claim 19, wherein the spiraling hair pin is held with the bottom substantially parallel to the users scalp, wherein twisting the hair pin in a direction opposite to the spiraling direction of the hair pin causes the spiraling hair pin to capture a portion of the section of hair within the inner spiral region.

21. The method of claim 18, wherein the second hair pin passes between one or more of the at least two rotations of the spiraling hair pin.

22. The method of claim 18, wherein the second hair pin is a spiraling hair pin that spirals in a spiraling direction two or more revolutions.

23. The method of claim 19, wherein the first hair pin is held with the elongated spiraling direction substantially parallel to the users scalp, wherein twisting the hair pin in a direction opposite to the spiraling direction of the hair pin causes a portion of the section of hair to gather within the inner spiraling region of the hair pin.

24. A device for styling hair, the device comprising a first spiral body section with a substantially uniform cone shape spiraling in a spiraling direction from a first end to a second end and from a larger radii of rotation to a smaller radii of rotation, wherein the first end is tapered for threading through hair and the second end is blunted to resist threading through hair, wherein the first spiral body section is configured to intertwine with a second spiral body section while the second device is threaded in hair.

25. The device in claim 24, wherein the spiral body section further comprises two or more rotations in a spiraling direction.

* * * * *